US007053324B2

(12) United States Patent
Shin

(10) Patent No.: US 7,053,324 B2
(45) Date of Patent: May 30, 2006

(54) SWITCHING MECHANISM FOR A MANUAL MOTOR STARTER

(75) Inventor: Bong Soo Shin, Ceongju-si (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 11/016,972

(22) Filed: Dec. 21, 2004

(65) Prior Publication Data

US 2005/0139462 A1 Jun. 30, 2005

(30) Foreign Application Priority Data

Dec. 26, 2003 (KR) ..... 10-2003-0097671

(51) Int. Cl.
*H01H 5/00* (2006.01)

(52) U.S. Cl. ..... 200/400; 200/401

(58) Field of Classification Search ..... 200/400–472, 200/318–327

See application file for complete search history.

(56) References Cited

U.S. PATENT DOCUMENTS 6,897,757 B1 * 5/2005 Kim ..... 336/130
2004/0114293 A1 * 6/2004 Kim ..... 361/92
2004/0124074 A1 * 7/2004 Asano et al. ..... 200/401
2005/0133352 A1 * 6/2005 Shin ..... 200/330
2005/0140475 A1 * 6/2005 Cho ..... 335/14

OTHER PUBLICATIONS

U.S. Appl. No. 11/016,911, filed Dec. 21, 2004, Cho.
U.S. Appl. No. 11/007,310, filed Dec. 9, 2004, Shin.

* cited by examiner

*Primary Examiner*—Michael Friedhofer
*Assistant Examiner*—Lisa Klaus
(74) *Attorney, Agent, or Firm*—Greenblum & Bernstein, P.L.C.

(57) ABSTRACT

The present invention relates to a switching mechanism for preventing a trip error of a manual motor starter. While using the manual motor starter, even though a latch holder (4) is incompletely released from restraint by a trip lever (3) during trip operation of the switching mechanism (1), the trip lever (3) is pushed upward to allow a restrained state of the latch holder (4) to be completely released at any event. Therefore, when implementing reset operation of the switching mechanism (1), as a latch (2) is smoothly introduced between both pins (4*a* and 4*b*) of the latch holder (4) rotated by a predetermined angle, it is possible to prevent breakage of the switching mechanism (1).

1 Claim, 5 Drawing Sheets

【Fig. 1】
PRIOR ART
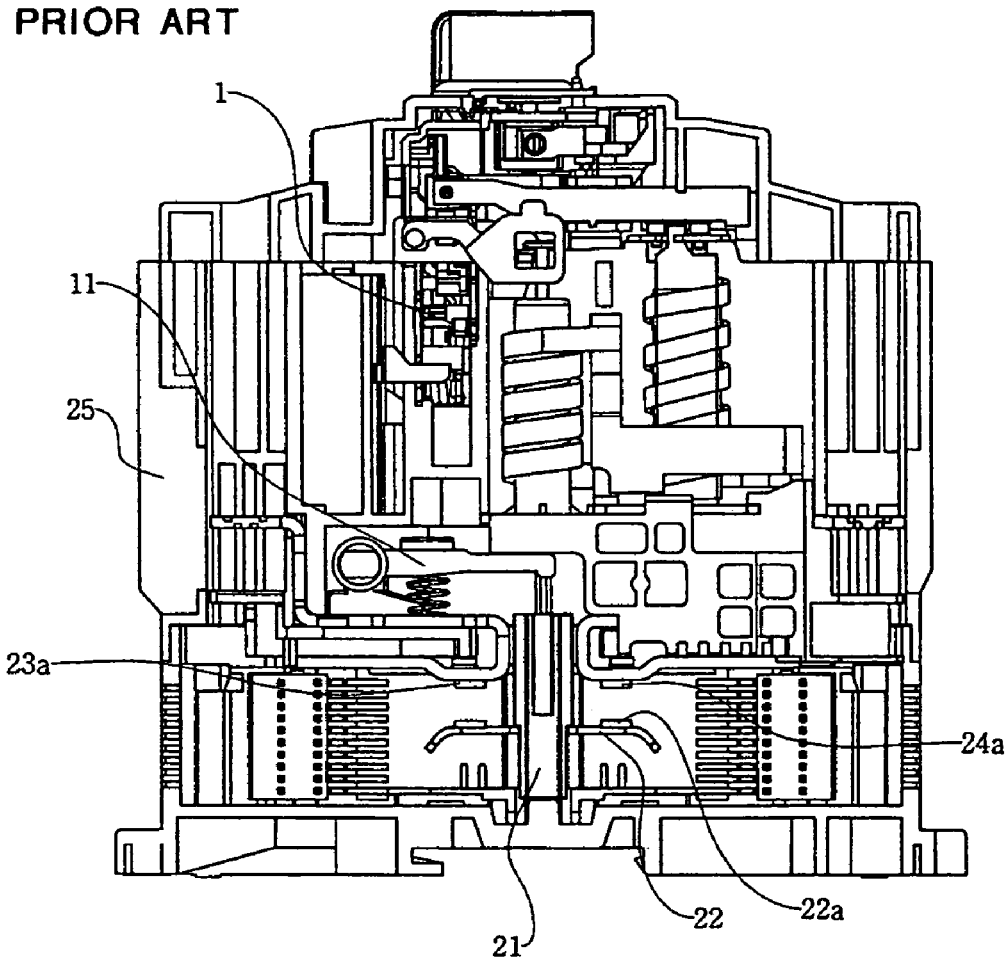
【Fig. 2a】
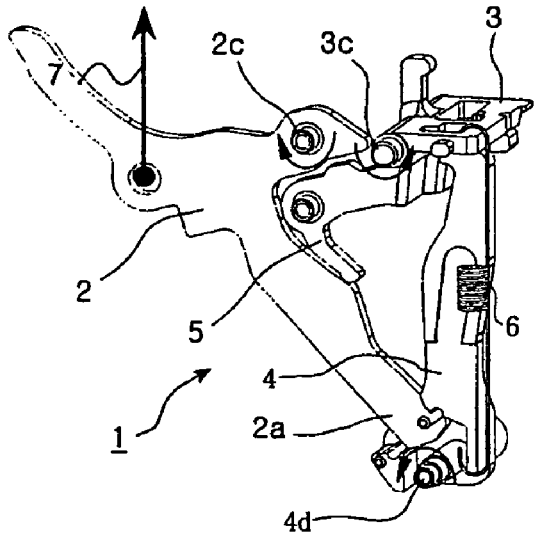
PRIOR ART

【Fig. 2b】
PRIOR ART
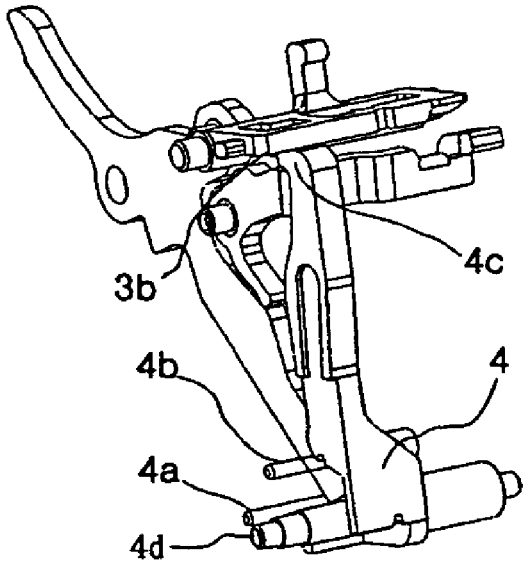
【Fig. 3a】
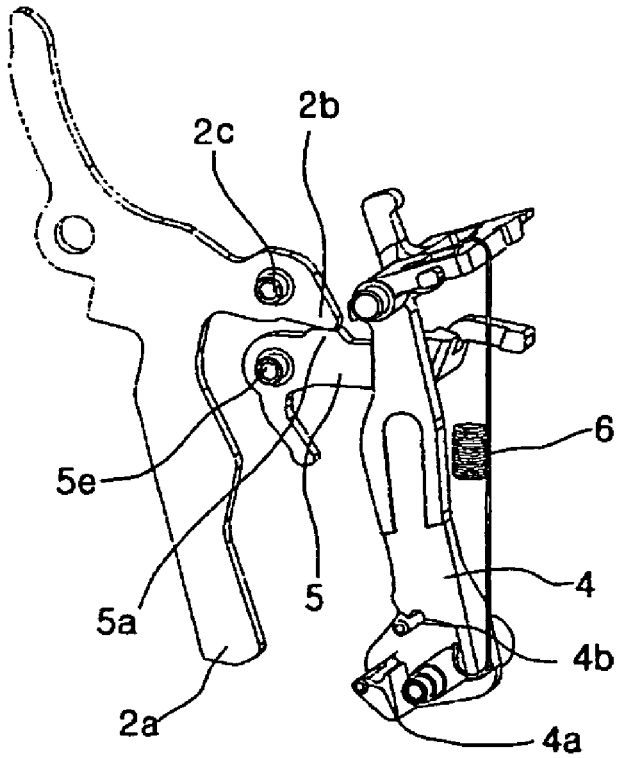
PRIOR ART

【Fig. 3b】 PRIOR ART
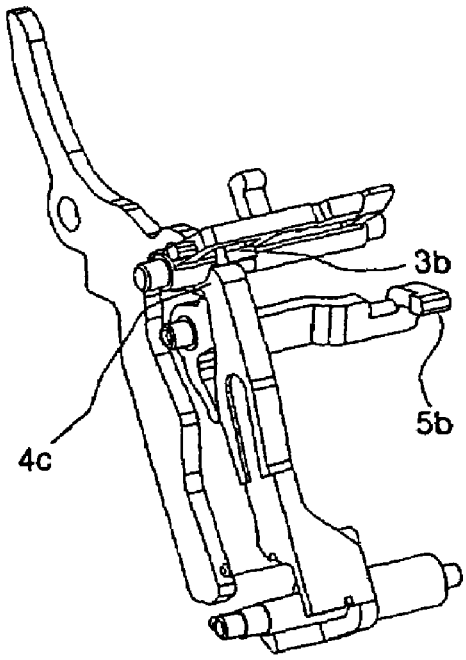
【Fig. 4】
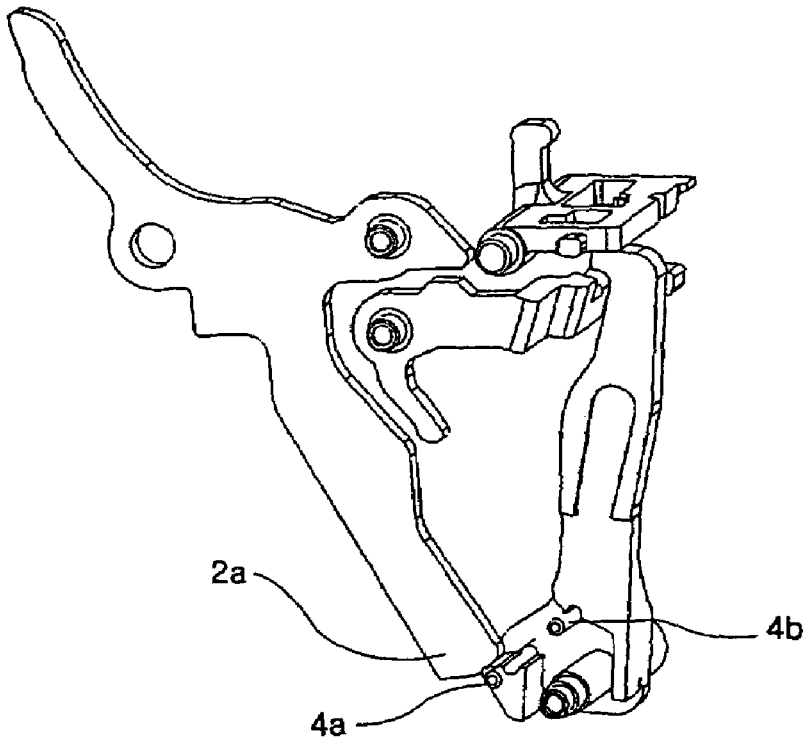
PRIOR ART

【Fig. 5】
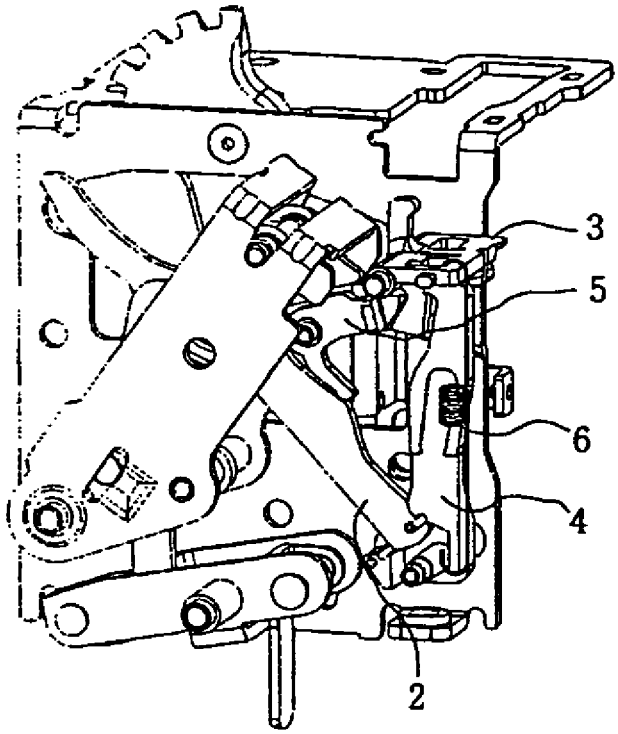
【Fig. 6】
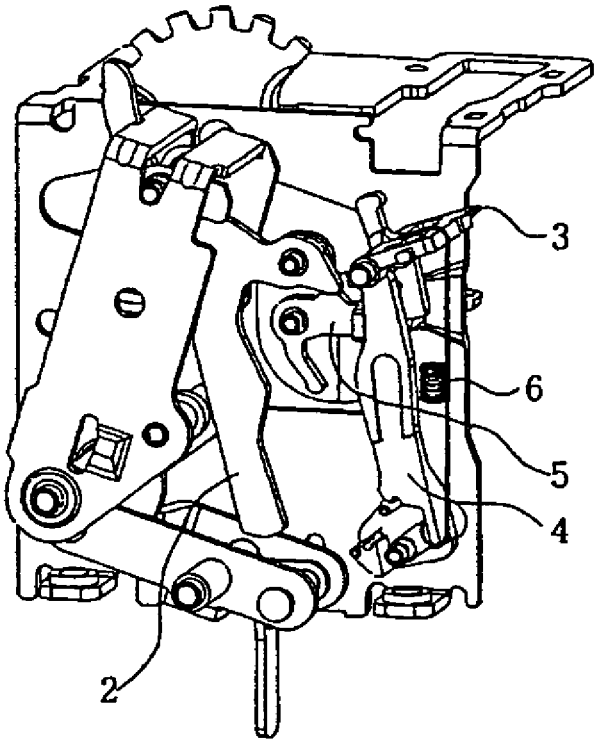

【Fig. 7a】
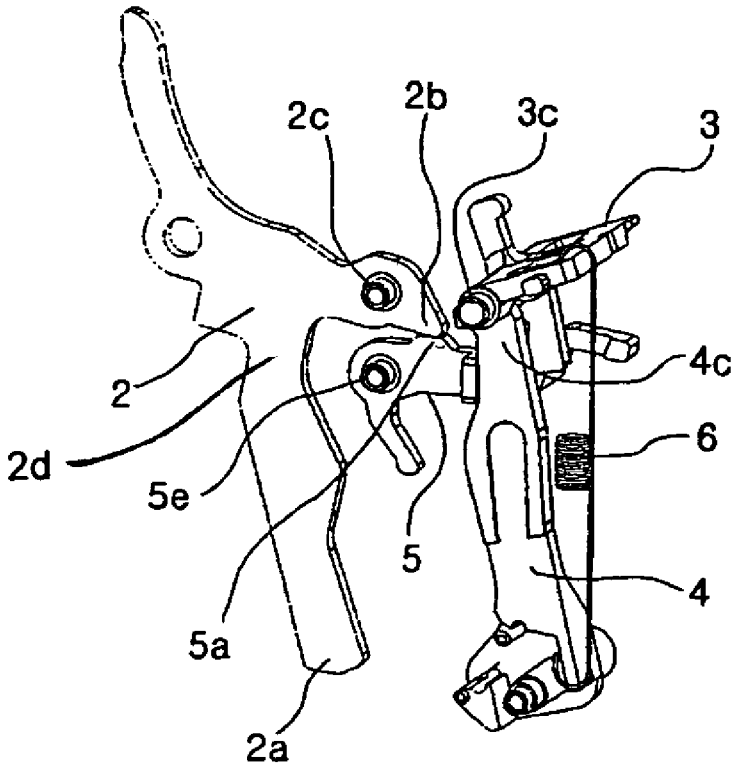
【Fig. 7b】
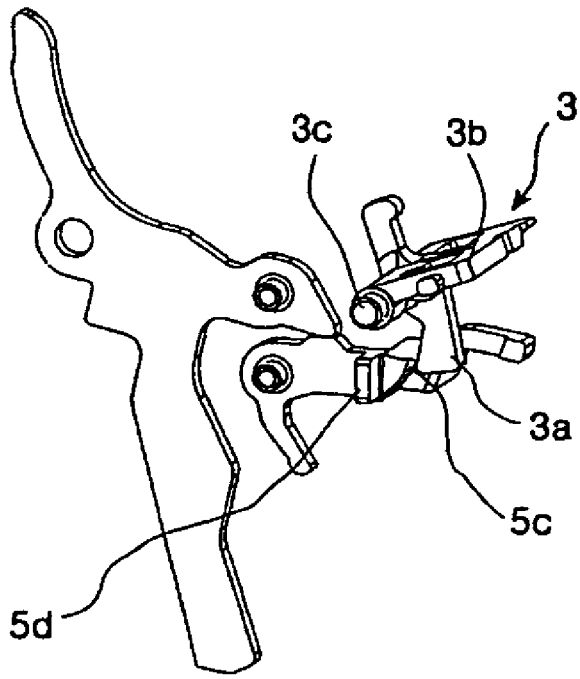

SWITCHING MECHANISM FOR A MANUAL MOTOR STARTER

TECHNICAL FIELD

The present invention relates to a switching mechanism for a manual motor starter, and more particularly, to a switching mechanism for a manual motor starter, in which trip operation of the switching mechanism is reliably implemented in spite of incomplete operation of some component elements, and breakage of the switching mechanism is prevented when implementing reset operation.

BACKGROUND ART

In general, a manual motor starter (so called MMS as abbreviated) serves as a switching device which has a function for protecting a motor by interrupting power supply to the motor upon generation of a fault current in a section for starting or stopping the motor, such as an electric shortage, a ground fault and an electric phase deficiency. The manual motor starter is also called a motor protection power-circuit breaker.

The manual motor starter is provided with a detecting section for detecting a fault current, a switching mechanism operated responding to a detection signal from the detecting section, a contact section interlocked with the operation of the switching mechanism to open or close a current path, and an arc extinguishing section for extinguishing an arc generated when contacts of the contact section are opened.

FIG. 1 is a schematic cross-sectional view of a conventional manual motor starter.

In FIG. 1, the reference numeral 1 designates a switching mechanism, 11 a crossbar, 21 a contact arm guide, 22 a movable contact arm, 22*a* movable contacts, 23*a* and 24*a* fixed contacts, and 25 an upper frame.

FIG. 2 is of perspective views illustrating operation of the switching mechanism for the conventional manual motor starter, wherein FIG. 2*a* is a perspective view illustrating the switching mechanism 1 in a state in which the manual motor starter is turned on and the contacts are closed, FIG. 2*b* is a perspective view taken at a different angle in FIG. 2*a* with a trip lever spring 6 omitted.

As shown in FIGS. 2*a* and 2*b*, the switching mechanism 1 comprises a latch 2, a trip lever 3, a latch holder 4 and a trip signal lever 5.

While the latch 2 is willing to rotate about its rotation shaft 2*c* due to a rotation moment 7 induced by a main spring (not shown), a leg portion 2*a* of the latch 2 is restrained by a stopper pin 4*a* of the latch holder 4. While the latch holder 4 is willing to rotate about its rotation shaft 4*d* due to the rotation moment 7 induced by the main spring which applies an elastic biasing force for rotating the latch 2 in a clockwise direction on a plane of the drawing, a head portion 4*c* of the latch holder 4 is restrained by a lock portion 3*b* of the trip lever 3. In order to prevent the trip lever 3 from rotating about its rotation shaft 3*c* in a counterclockwise direction, the trip lever spring 6 is connected between the trip lever 3 and the latch holder 4.

In this state, if the switching mechanism 1 of the manual motor starter implements trip operation, as driving force is transmitted to the trip lever 3 from the detection section, the trip lever 3 is rotated about the rotation shaft 3*c* in the counterclockwise direction on the plane of the drawing while overcoming an elastic biasing force of the trip lever spring 6. By this fact, the head portion 4*c* of the latch holder 4 is released from restraint by the lock portion 3*b* of the trip lever 3, and the latch holder 4 is rotated about its rotation shaft 4*d* in the counterclockwise direction. Further, as the leg portion 2*a* of the latch 2 is released from restraint by the stopper pin 4*a* of the latch holder 4, the latch 2 is rotated about its rotation shaft 2*c* in the clockwise direction due to the rotation moment 7 induced by the main spring. If the rotation moment 7 of the main spring vanishes, the latch 2 is stopped at a predetermined position by a stopper (not shown) to complete the trip operation, as shown in FIG. 3.

FIG. 3 are perspective views illustrating operation of the switching mechanism for the conventional manual motor starter, wherein FIG. 3*a* is a perspective view illustrating the switching mechanism in a state in which the manual motor starter is tripped and the contacts are opened, and FIG. 3*b* is a perspective view taken at a different angle in FIG. 3*a* with the trip lever spring 6 omitted.

If the trip operation of the switching mechanism 1 is implemented, as the latch 2 is rotated, a beak portion 2*b* of the latch 2 is also rotated about the latch rotation shaft 2*c* in the clockwise direction. At this time, as the beak portion 2*b* presses a projection 5*a* of the trip signal lever 5, the trip signal lever 5 is rotated about its rotation shaft 5*e*, and a leg portion 5*b* of the trip signal lever 5 is moved downward to perform a function of transmitting power to an accessory device for indicating a tripped state.

If the switching mechanism 1 is reset, the leg portion 2*a* of the latch 2 which is in a position shown in FIG. 3 is rotated about its rotation shaft 2*c* in the counterclockwise direction and is introduced between the stopper pin 4*a* and a power transmitting pin 4*b* of the latch holder 4. Thereafter, as the leg portion 2*a* of the latch 2 pushes the power transmitting pin 4*b*, the latch holder 4 is raised. Then, after the head portion 4*c* of the latch holder 4 passes while slightly lifting the trip lever 3, the head portion 4*c* of the latch holder 4 is moved back by an elastic biasing force of the trip lever spring 6 so that it is naturally restrained by the lock portion 3*b* of the trip lever 3 to define a turned-on state as shown in FIG. 2.

In the conventional manual motor starter, when the trip operation is implemented in a state in which the switching mechanism 1 is turned on and the contacts are closed, in the case that the head portion 4*c* of the latch holder 4 is incompletely released from restraint by the lock portion 3*b* of the trip lever 3, the latch 2 having a relatively large rotation moment 7 is barely released from restraint by the stopper pin 4*a* of the latch holder 4 and is rotated about its rotation shaft 2*c* to implement the trip operation for opening the contacts. However, the latch holder 4 cannot properly reach a trip completion position shown in FIG. 3 by interference with the trip lever 3 and other unexpected limitations, and still remains restrained by the trip lever 3 in an unstable state. In this state, if a user applies a force to a handle (not numbered) to reset the manual motor starter, the leg portion 2*a* of the latch 2 which is normally maintained in the trip position is rotated about the latch rotation shaft 2*c* toward the latch holder 4. At this time, since the latch holder 4 is maintained in an abnormal position in which it is not rotated in the counterclockwise direction, as can be readily seen from FIG. 4, the leg portion 2*a* of the latch 2 collides with the lower end of the latch holder 4. In this state, if the user further applies a force to the latch 2, the latch 2 or the latch holder 4 is likely to be broken, whereby the switching mechanism 1 may lose its functionality.

DISCLOSURE OF THE INVENTION

Therefore, the present invention has been made in view of the above-mentioned problems, and an object of the present invention is to provide a switching mechanism for a manual motor starter, which a voids a phenomenon that a latch holder is incompletely released from a locked state by a trip lever when trip operation of the switching mechanism is implemented while using the manual motor starter.

In order to achieve the above object, according to the present invention, there is provided a switching mechanism for a manual motor starter, comprising: a latch having a body which possesses a shape extending in a vertical direction, a leg which is formed at a lower end of the body, and a beak portion which extends in a horizontal direction from an upper portion of the body, the latch being rotated during trip operation of the switching mechanism;

a latch holder capable of being rotated by a pushing force of the rotating latch, to lock or release the latch;

a trip signal lever installed within a rotation range of the beak portion of the latch and rotated by a pressing force of the beak portion while the latch is rotated; and a trip lever having a lock portion for locking or releasing a head formed in an upper portion of the latch holder and a leg portion for receiving a pushing force from the trip signal lever, the trip lever being rotated by a pushing force which the trip signal lever applies while being rotated, to release the latch holder.

BRIEF DESCRIPTION OF THE DRAWINGS

The foregoing and other objects, features and advantages of the present invention will become more apparent from the following detailed description when taken in conjunction with the accompanying drawings in which:

FIG. 1 is a schematic cross-sectional view of a conventional manual motor starter;

FIGS. 2 and 3 are perspective views illustrating operation of a switching mechanism for the conventional manual motor starter, wherein FIG. 2*a* is a perspective view illustrating the switching mechanism in a state in which the manual motor starter is turned on and contacts are closed, FIG. 2*b* is a perspective view taken at a different angle in FIG. 2*a* with a trip lever spring omitted, FIG. 3*a* is a perspective view illustrating the switching mechanism in a state in which the manual motor starter is tripped and the contacts are opened, and FIG. 3*b* is a perspective view taken at a different angle in FIG. 3*a* with the trip lever spring omitted;

FIG. 4 is a perspective view illustrating a state in which an erroneous stopping phenomenon occurs while implementing reset operation with a trip error caused in the switching mechanism of the conventional manual motor starter;

FIG. 5 is a perspective view schematically illustrating a switching mechanism for a manual motor starter in accordance with an embodiment of the present invention, in a state in which the manual motor starter is turned on and contacts are closed.

FIG. 6 is a perspective view schematically illustrating the switching mechanism for a manual motor starter according to the present invention, in a state in which the manual motor starter is tripped and the contacts are opened;

FIG. 7*a* is a perspective view illustrating main component elements of the switching mechanism according to the present invention, in a state in which the manual motor starter is tripped and the contacts are opened; and FIG. 7*b* is a perspective view obtained by omitting a latch holder and a latch holder spring in FIG. 7*a*.

BEST MODE FOR CARRYING OUT THE INVENTION

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 5 is a perspective view schematically illustrating a switching mechanism for a manual motor starter in accordance with an embodiment of the present invention, in a state in which the manual motor starter is turned on and contacts are closed, that is, the movable contacts 22*a* and the fixed contacts 23*a* of FIG. 1 are brought into contact with each other; FIG. 6 is a perspective view schematically illustrating the switching mechanism for a manual motor starter according to the present invention, in a state in which the manual motor starter is tripped and the contacts are opened, that is, the moving contacts 22*a* and the fixed contacts 23*a* of FIG. 1 are separated from each other.

In FIGS. 5 and 6, the reference numeral 2 designates a latch, 3 a trip lever, 4 a latch holder, 5 a trip signal lever, and 6 a latch holder spring.

Hereafter, a construction of the present invention will be described with reference to FIG. 7*a* which is a perspective view illustrating main component elements of the switching mechanism according to the present invention, in a state in which the manual motor starter is tripped and the contacts are opened, and FIG. 7*b* which is a perspective view obtained by omitting the latch holder 4 and the latch holder spring 6 in FIG. 7*a*.

Referring to FIGS. 7*a* and 7*b*, the switching mechanism 1 for a manual motor starter according to the present invention comprises a latch 2 having a body 2*d* which possesses a shape extending in a vertical direction, a leg 2*a* which is formed at a lower end of the body 2*d*, and a beak portion 2*b* which extends in a horizontal direction from an upper portion of the body 2*d*, the latch 2 being rotated about a rotation shaft 2*c* during trip operation of the switching mechanism 1; a latch holder 4 capable of being rotated by a pushing force of the rotating latch 2, to lock or release the latch 2; a trip signal lever 5 installed within a rotation range of the beak portion 2*b* of the latch 2 for locking the latch holder 4 or for being rotated by a pressing force of the beak portion 2*b* while the latch 2 is rotated; and a trip lever 3 having a lock portion 3*b* for locking or releasing a head 4*c* formed in an upper portion of the latch holder 4 and a leg portion 3*a* for receiving a pushing force from the trip signal lever 5, the trip lever 3 being rotated by a pushing force which the trip signal lever 5 applies while being rotated, to release the latch holder 4.

Similarly to the conventional latch 2 shown in FIG. 2, an upper portion of the latch 2 is connected with one end of a main spring. The latch 2 is biased by the main spring to be rotated about the rotation shaft 2*c* in a clockwise direction.

Similarly to the conventional latch holder 4 shown in FIG. 3*a*, a lower part of the latch holder 4 is provided with a rotation shaft serving as a rotation center of the latch holder 4, a latch stopper pin 4*a*, and a power transmitting pin 4*b*. When the manual motor starter is turned on, that is, maintained in a reset state, the latch holder 4 restrains, using a biasing force of the spring, the lower end of the latch 2 from being rotated, or releases the latch 2 to allow the latch 2 to be rotated in the clockwise direction on a plane of the drawing by the biasing force of the spring.

The trip signal lever 5 is installed to be able to rotate about a rotation shaft 5*e* which is positioned below the beak portion 2*b* of the latch 2. The trip signal lever 5 comprises a substantially 'L'-shaped member which is composed of a first portion extending downward from a position where the rotation shaft 5*e* is installed and a second portion extending horizontally from the position where the rotation shaft 5*e* is installed. The trip signal lever 5 has a stopper portion 5*d* which is formed on the middle of the second portion to prevent rotation of the latch holder 4 during trip operation, and a nose portion 5*c* which is a protrude projecting toward the leg portion 3*a*. The nose portion 5*c* pushes the leg portion 3*a* of the trip lever 3 during the trip operation to rotate the trip lever 3 in a counterclockwise direction on the plane of the drawing. At this time, by a pushing force of the lower end of the latch 2 which is released from the lock portion 3*b* of the trip lever 3 and rotated in the clockwise direction and by an elastic force of the trip lever spring 6 which is installed and has both ends supported between the trip lever 3 and the latch holder 4, the latch holder 4 is rotated in the counterclockwise direction. As in the conventional art, the trip signal lever 5 has another function of transmitting a driving force to an accessory mechanism which can be attached to the manual motor starter as a optional component part to indicate a tripped state. For this power transmission, the trip signal lever 5 has the component part which performs the same function as the conventional power transmitting pin 4*b*.

The unexplained reference numeral 5*a* designates a protrude which is projectedly formed on a proximal zone of the second portion of the trip signal lever 5 to receive a downward pressing force from the beak portion 2*b* of the latch 2 as in the conventional art.

The trip lever 3 according to the present invention is distinguished from that of the conventional art in that the present trip lever 3 has the leg portion 3*a* which extends downward from the trip lever 3 for receiving a rotational pushing force from the trip signal lever 5. The trip lever 3 is installed such that the leg portion 3*a* is opposed to the nose portion 5*c* of the trip signal lever 5.

Hereafter, operation of the switching mechanism 1 for a manual motor starter according to the present invention, constructed as mentioned above, will be described in detail.

First, the trip operation of the switching mechanism for a manual motor starter according to the present invention will be described. If a large current flows through a motor due to an electric shortage or a ground fault, by a driving force from a detecting and trip mechanism (not shown) which detects the large current and provides the driving force for rotating the trip lever 3, the trip lever 3 is rotated in the counterclockwise direction while overcoming the elastic biasing force of the trip lever spring 6.

At this time, the latch holder 3 is released from the lock part 3*b* of the trip lever 3. Then, by the pushing force of the lower end of the latch 2 which is rotated in the clockwise direction by the elastic biasing force of the spring and the elastic force of the trip lever spring 6 which is installed and has both ends supported between the trip lever 3 and the latch holder 4, the latch holder 4 is rotated in the counterclockwise direction on the plane of the drawing.

As the beak portion 2*b* of the latch 2 rotating in the clockwise direction is brought into contact with the protrude 5*a* of the trip signal lever 5 and pushes downward the trip signal lever 5, the trip signal lever 5 is rotated in the clockwise direction on the plane of the drawing. Due to the fact that the nose portion 5*c* of the rotating trip signal lever 5 pushes the leg portion 3*a* of the trip lever 3 to rotate the trip lever 3 about its rotation shaft 3*c* in the counterclockwise direction, even when the head 4*c* of the latch holder 4 is not completely released from the lock portion 3*b* of the trip lever 3, the latch holder 4 can be completely released and rotated.

At this time, counterclockwise rotation of the latch holder 4 is limited by the stopper portion 5*d* provided to the trip signal lever 5 to a predetermined rotation angle.

By the rotation of the latch 2, the movable contacts 22*a* and the movable contact arm 22 as shown in FIG. 1 which are drivably connected with the latch 2 through an not shown connection mechanism are separated from the fixed contacts 23*a* and 24*a* to trip the manual motor starter, whereby power supply to an electric circuit connected to the motor is interrupted.

Hereinbelow, operation for resetting, that is, returning to an ON position the switching mechanism for a manual motor starter according to the present invention after causes of the electric shortage or the ground fault are removed, will be described.

If an unexplained handle is manually rotated to an ON position, the latch 2 which is connected with a handle mechanism is rotated in the counterclockwise direction on the plane of the drawing while overcoming the elastic biasing force of the spring. Thereupon, an end surface of the leg 2*a* of the latch 2 slides over the stopper pin 4*a* of the latch holder 4, and the leg 2*a* of the latch 2 pushes upward the power transmitting pin 4*b*. Then, as the latch holder 4 is raised by the upward pushing force of the power transmitting pin 4*b*, the head 4*c* of the latch holder 4 is locked to the lock portion 3*b* of the trip lever 3, and this locked state is maintained by the elastic biasing force of the trip lever spring 6. Simultaneously, the leg 2*a* of the latch 2 is positioned between the stopper pin 4*a* and the power transmitting pin 4*b* of the latch holder 4.

As apparent from the above description, in the present invention, when implementing trip operation of the switching mechanism while using the manual motor starter, even though the latch holder 4 is incompletely released from restraint by the trip lever 3, since the nose portion 5*c* of the trip signal lever 5 which is interlocked with the latch 2 forcibly pushes the leg portion 3*a* of the trip lever 3 and rotates the trip lever 3, the locked state of the latch holder 4 can be completely released at any event. Accordingly, when implementing reset operation of the switching mechanism 1, as the latch 2 is smoothly introduced between both pins 4*a* and 4*b* of the latch holder 4 rotated by the predetermined angle, it is possible to prevent breakage of the switching mechanism 1.

While this invention has been described in connection with what is presently considered to be the most practical and preferred embodiment, it is to be understood that the invention is not limited to the disclosed embodiment and the drawings, but, on the contrary, it is intended to cover various modifications and variations within the spirit and scope of the appended claims.

The invention claimed is:

1. A switching mechanism for a manual motor starter, comprising:

a latch having a body which possesses a shape extending in a vertical direction, a leg which is provided at a lower end of the body, and a beak portion extending in a horizontal direction from an upper portion of the body, the latch being rotated during trip operation of the switching mechanism;

a latch holder capable of being rotated by a pushing force of the rotating latch, to lock or release the latch;

a trip signal lever installed within a rotation range of the beak portion of the latch and rotated by a pressing force of the beak portion while the latch is rotated; and a trip lever having a lock portion that locks or releases a head provided on an upper portion of the latch holder and a leg portion that receives a pushing force from the trip signal lever, the trip lever being rotated by a pushing force which the trip signal lever applies while being rotated, to release the latch holder, wherein the trip signal lever has a stopper portion that stops the latch holder which is rotated during the trip operation.

* * * * *